US006230823B1

(12) United States Patent
Sieniawski

(10) Patent No.: US 6,230,823 B1
(45) Date of Patent: May 15, 2001

(54) DOWNHOLE MOTOR

(76) Inventor: Dariusz Sieniawski, 3148 Qual Dr., Ottawa (CA), K1T 1V2

( * ) Notice: Subject to any disclaimer, the term of this patent is extended or adjusted under 35 U.S.C. 154(b) by 0 days.

(21) Appl. No.: 09/185,420

(22) Filed: Nov. 3, 1998

(51) Int. Cl.[7] ..... E21B 4/02
(52) U.S. Cl. ..... 175/107; 175/101; 175/106
(58) Field of Search ..... 175/107, 106, 175/101; 418/58

(56) References Cited

U.S. PATENT DOCUMENTS 908,365 * 12/1908 Ward ..... 418/58
3,852,002 * 12/1974 Sieniawski ..... 418/61.1
4,415,316 * 11/1983 Jurgens ..... 418/48

* cited by examiner

*Primary Examiner*—Robert E. Pezzuto
*Assistant Examiner*—Meredith C. Petravick

(57) ABSTRACT

A downhole hydraulic motor consisting of an outer rim having six or eight lobes on the toothed inner surface, a rotor having four or six lobes respectively on the toothed outer surface as well as a number of planetary gears being constantly engaged with both the outer rim and the rotor and dividing the space between the rim and the rotor into a number of working chambers changing their volume with the rotation of the motor. The working fluid is supplied to the working chambers through channels both in the rotor and the side covers, one of which can slide inside the outer rim to allow adjustment of the gap between the ends of the planetary gears and the side covers.

12 Claims, 4 Drawing Sheets

SECTION A-A

SECTION B-B

SECTION A-A

SECTION B-B

SECTION A-A

SECTION B-B

DOWNHOLE MOTOR

CROSS-REFERENCE TO RELATED APPLICATIONS

Following U.S. patents may be relevant to this invention:

U.S. Pat. No. 2,990,894 by J. A. Mitchel et al, Jul. 4, 1961

U.S. Pat. No. 3,112,801 by W. Clark et al, Mar. 5, 1959

U.S. Pat. No. 3,840,080

U.S. Pat. No. 5,090,497

U.S. Pat. No. 4,567,867

U.S. Pat. No. 3,852,002

STATEMENT REGARDING FEDERALLY SPONSORED RESEARCH OR DEVELOPMENT

Not Applicable

BACKGROUND OF THE INVENTION

This invention relates to a positive displacement motor that can be used, among other applications, for drilling oil and gas exploration holes, oil wells and directional holes for different purposes.

In some cases of exploration holes it is necessary to produce drilling power right on the drilling bit that may be operating deep in a hole that may be curved (not straight). In such cases a positive displacement motor is required, usually powered by pressurized fluid/gas mixture pumped from the surface. The motor transforms mainly hydrostatic energy of the fluid/gas mixture into rotary motion being used to power the drilling bit in the hole.

Prior positive displacement motors for drilling exhibit a few disadvantages. Some of them require a universal joint that has to carry all drilling power since the motor itself performs a complex motion (two circular motions combined). Prior motors may contain polymer parts which would wear out thus reducing duration of drilling runs. Other disadvantage of the prior motors is substantial length of the motor required to generate a sufficient power for the drilling bit. Such lengthy motors may be sensitive to high bending moments that may occur under some drilling conditions.

BRIEF STATEMENT OF THE INVENTION

The invention is directed to a positive displacement motor for drilling oil and gas exploration wells where the drilling power should be generated in the close proximity of the drilling bit. The object of the present invention is to provide a motor that would not require universal joint and would be shorter in length than the present designs, maintaining the same displacement per revolution as well as be manufacturing friendly.

The new motor consists of the fixed external housing, which contains outer rim shaped (see FIG. 1) such that it has six or eight lobes on the toothed, inner surface, the rotor that rotates around a fixed axis and has four or six lobes on the toothed outer surface as well as ten or fourteen planetary gears being engaged with both the outer rim and the rotor, dividing space between the two into ten or fourteen working chambers changing their volume with the rotation of the rotor.

DETAILED DESCRIPTION OF PREFERRED EMBODIMENTS

Figure 1:
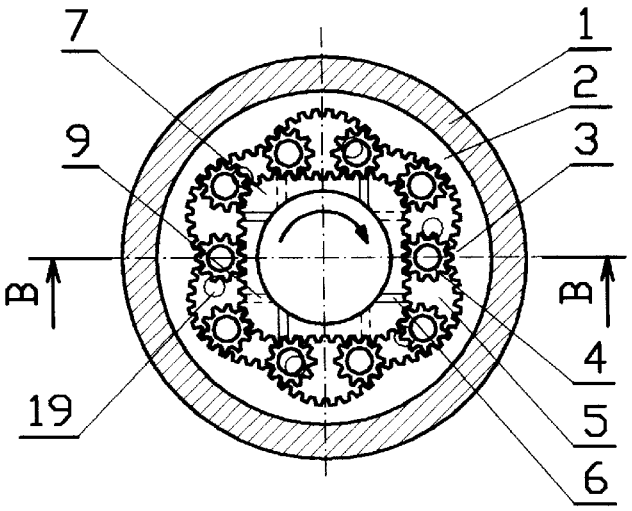
FIG. 1 illustrates the cross section of a downhole motor having six lobes on the outer rim and four lobes on the rotor.

FIG. 1 shows a cross section of a downhole motor comprising housing (1) holding a number of fixed outer rims (2) which are centered inside the housing and aligned with respect to each other by means of alignment pins or screws such that all teeth are continuously aligned from one end of the assembly to the other end. The four lobe rotor (7), which also consists of several aligned and mounted together sections, can rotate about its axis coinciding with that of the outer rim. Planetary gears (4) are located between the outer rim and the rotor, being constantly engaged with both the outer rim and the rotor and dividing the space between the outer rim and the rotor into ten working chambers (5). Each planetary gear has ten teeth around its circumference, however nine and eight teeth planetary gears are also possible. Each of the lobes (3) has eleven teeth counting from one lowest point between the lobes to the next lowest point between the lobes. In the case of the motor having planetary gears with ten teeth, one of the teeth on each lobe coincides with the highest point on that lobe such that the symmetry plane of the tooth coincides with the symmetry plane of the lobe which is crossing the highest point on that lobe. This is true for the lobes on both outer rim and the rotor. Lobes with ten teeth are possible when planetary gears have nine teeth and lobes with nine teeth are possible when planetary gears have eight teeth.

The volume of each working chamber changes with the rotation of the rotor. Chambers increasing their volume are connected via channels (6) in the rotor as well as channels (19) in the top side cover to the high pressure side. In a similar fashion chambers decreasing their volume are connected via channels (9) in the rotor to the low pressure side, assuming clockwise rotation of the rotor. Rotating planetary gears act as a distributor covering and opening appropriate channels as the chambers go from decreasing their volume to increasing their volume or the other way around. Teeth on the outer rim, rotor and planetary gears help seal the working chambers and maintain planetary gears in the right position with respect to the rim and the rotor, such that no jamming occurs at any angular position of the rotor with respect to the outer rim.

Figure 2:
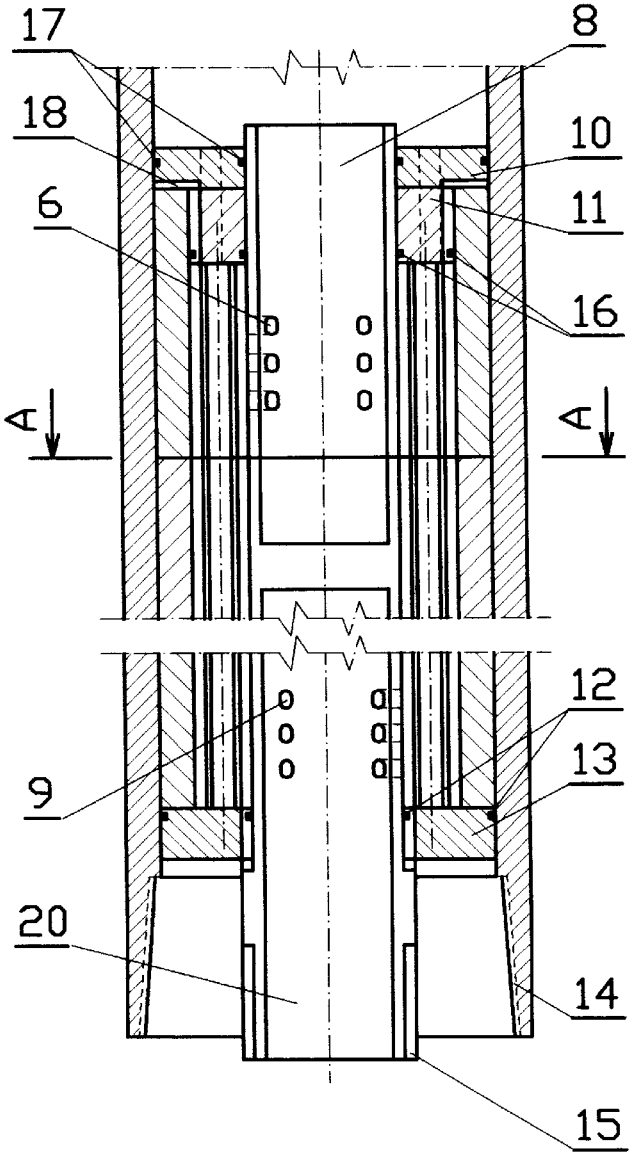
FIG. 2 illustrates the section along the axis of a downhole motor having six lobes on the outer rim and four lobes on the rotor showing detail of the pressure compensation.

FIG. 2 shows a section along the axis of a downhole motor with six lobes on the outer rim and four on the rotor. High pressure fluid enters the working chambers through the blind hole (8) in the rotor extending to about half of the rotors length, feeding multiple channels (6) along the rotor connected with chambers increasing their volume. Those chambers are also connected to the high pressure fluid via holes in the end plate (11). Chambers decreasing their volume are connected with channels (9) to another blind hole (20) in the rotor, extending from about half of the rotors length towards the drilling bit. Compensation plate (11) has an external toothed surface matching the inside surface of the outer rim, such that it can slide back and forth inside the outer rim in order to keep the gap between the ends of the planetary gears and both end covers independent of distortions and wear of the motor. In order to reduce leaks between the high and the low pressure side of the motor end cover (11) is equipped with sealings (16) in close proximity to the working section of the motor. Compensation pressure zone (18) is limited by the cover (10) with sealings (17), end cover (11), the rotor and the housing. At the opposite end of the working section of the motor there is a cover (13) sealed on the rotor and the housing with sealings (12).

The motor can be connected with another section of the drilling assembly such as the bearing assembly by means of a high torque connection (14). Torque generated by the motor is passed to the drilling bit using a coupling (15). The outer rim of the motor shown consists of a number of sections positioned inside the housing and aligned such that there is no offset between the teeth, using alignment pins and mounted together by means of multiple screws. The rotor is assembled in a similar fashion of multiple sections, aligned and connected together. The planetary gears also consist of aligned, multiple sections coinciding with the sections of the outer rim and the rotor.

Figure 3:
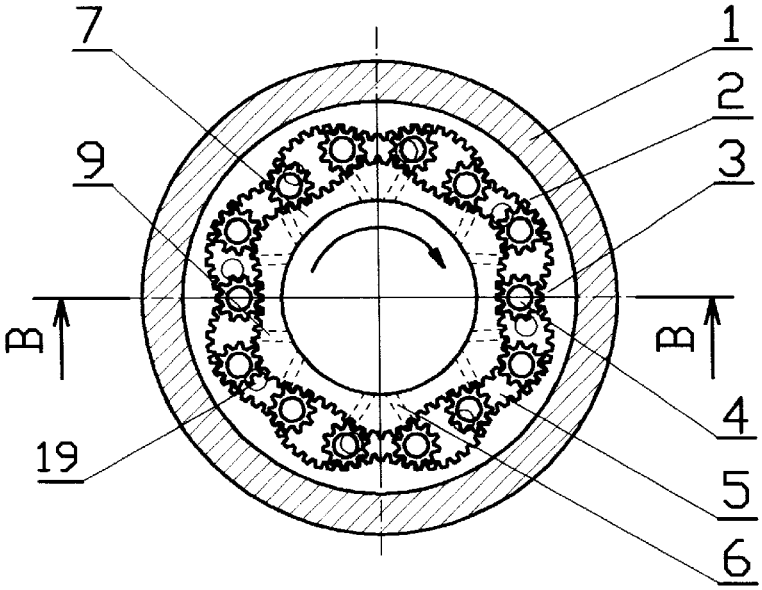
FIG. 3 presents a cross section of a downhole motor with eight lobes on the outer rim and six lobes on the rotor.

FIG. 3 shows a cross section of the second embodiment of a downhole motor having eight lobes on the outer rim and six on the rotor. The motor consists of a housing (1) holding a number of outer rims (2) which are centered inside the housing and aligned with respect to each other by means of alignment pins or screws such that all teeth are continuously aligned from one end of the assembly to the other end. The six lobe rotor (7), which is made as one part, can rotate about its axis. Planetary gears (4) are located between the outer rim and the rotor, being constantly engaged with both the outer rim and the rotor and dividing the space between the outer rim and the rotor into fourteen working chambers (5). Each planetary gear has ten teeth around its circumference, however nine and eight teeth planetary gears are also possible. Each of the lobes (3) has eleven teeth counting from one lowest point between the lobes to the next lowest point between the lobes. One of the teeth on the lobe coincides with the highest point on the lobe such that the symmetry plane of the tooth coincides with the symmetry plane of the lobe, crossing the highest point on the lobe. This is true for lobes on both outer rim and the rotor. Lobes with ten teeth are possible when planetary gears have nine teeth and lobes with nine teeth are possible when planetary gears have eight teeth.

The volume of each working chamber changes with the rotation of the rotor. Chambers increasing their volume are connected via channels (6) in the rotor to the high pressure side. In a similar fashion chambers decreasing their volume are connected via channels (9) in the rotor and (19) in the drilling bit side cover to the low pressure side. Rotating planetary gears act as a distributor covering and opening appropriate channels as the chambers go from decreasing their volume to increasing their volume or the other way around.

Figure 4:
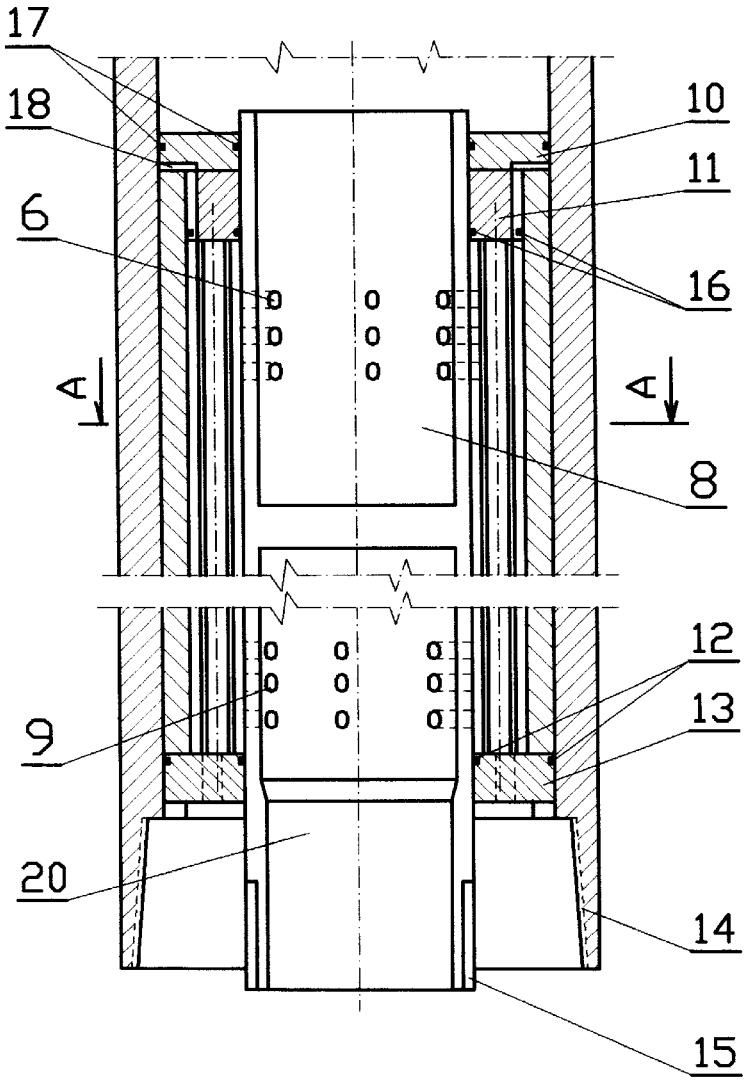
FIG. 4 shows a section along the axis of such motor.

FIG. 4 shows a section along the axis of the second embodiment of the downhole motor with eight lobes on the outer rim and six on the rotor. High pressure fluid enters the working chambers through the blind hole (8) in the rotor extending to about half of the rotors length, feeding multiple channels (6) along the rotor, connected with chambers increasing their volume. Chambers decreasing their volume are connected with holes (19) in the end plate (13) channels (9) to another blind hole (20) in the rotor, extending from about half of the rotors length towards the drilling bit. The end plate (13) has an opening matching the shape of the rotor allowing the rotor to slide with respect to the cover which facilitates compensation of rotor distortions during the operation of the motor. The cover is sealed with sealings (12). A compensation plate (11) has an external, toothed, surface matching inside surface of the outer rim, such that it can slide back and forth inside the outer rim in order to keep the gap between the ends of the planetary gears and both end covers, independent of distortions and wear of the motor. In order to reduce leaks between the high and the low pressure side of the motor the end cover (11) is equipped with sealings (16) in close proximity to the working section of the motor. The compensation pressure zone (18) is limited by the cover (10) with sealings (17), the end cover (11), the rotor and the housing.

The motor can be connected with another section of the drilling assembly such as bearing assembly by means of the high torque connection (14). Torque generated by the motor is passed to the drilling bit using the coupling (15). The outer rim of the motor shown consist of a number of sections positioned inside the housing and aligned such that there is no offset between the teeth, using alignment pins and mounted together by means of multiple screws. The rotor is manufactured as one part. The planetary gears also consist of aligned, multiple sections coinciding with the sections of the outer rim and the rotor.

Figure 5:
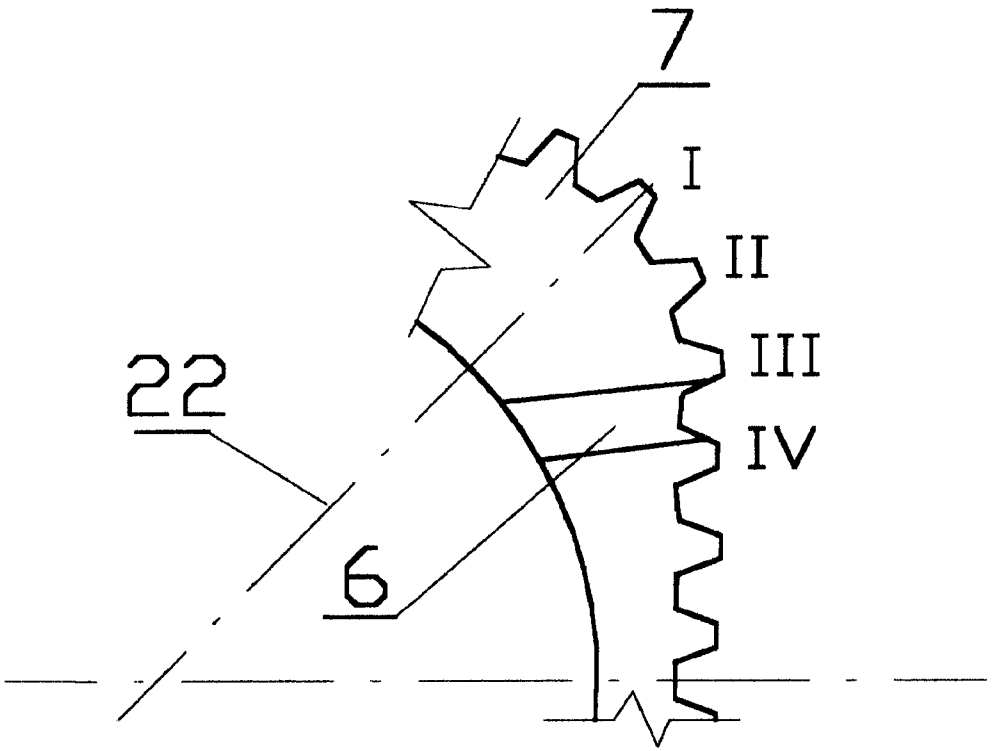
FIG. 5 illustrates the location of the rotor supply channel opening.

FIG. 5 illustrates the location of the channel (6) through which working fluid enters the working chambers of the motor and which is located in the rotor (7) of the motor. In the case of the motor with four lobes on the rotor there are four possible locations of the supply channels and four of the drain channels for a given direction of rotation. On each lobe of the rotor there is one location for the supply channel and one for the drain channel. Locations for both channels are positioned symmetrically with respect to the lobe symmetry plane (22) passing through the highest point on the lobe which coincides with the symmetry plane of the tooth (11). It was found that of the many possible shapes of the outer rim and rotor lobes which correspond to many possible locations of the supply channels on the rotor, the ones which require the channel to be located between the third and the fourth tooth as shown on FIG. 5 are particularly suitable for a downhole motor. Those motors exhibit high displacement per unit of length as well as geometry of the outer rim and the rotor, which allows larger radii on both the outer rim and the rotor and therefore less undercut teeth which in turn allows higher pressure difference between the chambers. It is also more convenient for the channel to be between the teeth since in such case the strength of the teeth is less affected by the presence of the channel, than in the case of the channel intersecting one of the teeth. FIG. 5 is also relevant to a motor with eight lobes on the outer rim and six on the rotor.

Figure 6:
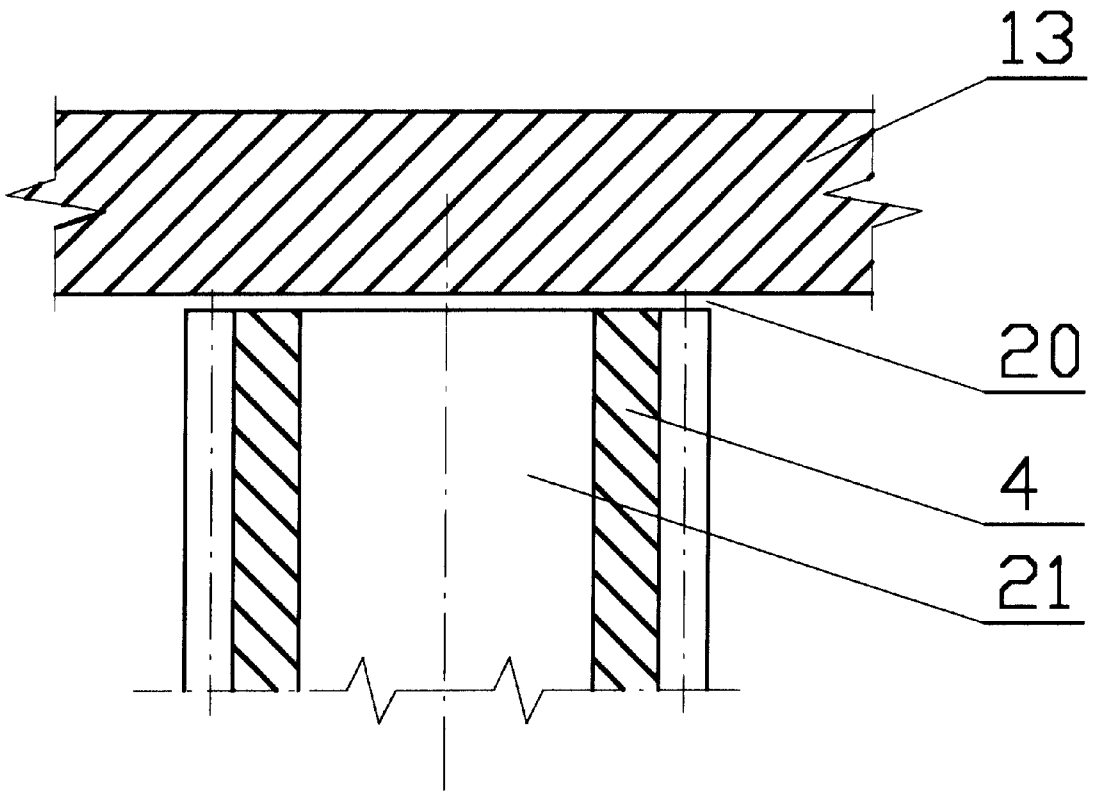
FIG. 6 presents the concept of creating a hydrostatic cushion between an end of a planetary gear and a side cover.

FIG. 6 shows a planetary gear (4) being close to one of the side covers (13). The amount of the gap (20) between the end of the planetary gear and the side cover is critical to the proper operation of the motor. Too small of a gap may cause too much mechanical friction between the ends of the planetary gears and the side covers, which may result in power losses or even damage to the motor. Too large of a gap may cause drop in the volumetric efficiency of the motor leading to a drop in the torque being generated by the motor. Both embodiments described on FIG. 2 and FIG. 4 take advantage of pressure and the axial gap compensation which means that at least one of the side covers can slide and is sealed inside the outer rim, such that the gap between the ends of the planetary gears and the covers is never too large. In order to prevent the gap from being to small the hole (21)

inside the planetary gear is connected to the high pressure zone of the motor via an orifice to control the flow of the working fluid in the case the gap becomes too large. Such arrangement will prevent the gap from becoming too small since closing the gap will cause the pressure in the hole (21) to rise and push the side cover away from the end of the planetary gear. A small amount of working fluid leaking from the hole (21) into the chambers connected to the draining channels will help to lubricate the end of the planetary gear and prevent damage to that end as well as to the side cover.

A downhole motor as described in the above two embodiments exhibits several advantages over turbine and helical motors. Turbine based motors require a large number of turbine stages in order to achieve required pressure drop on the motor. Turbine motors are expensive and their overall efficiency drops at low rotating speeds, limiting available torque. Helical motors require a universal joint or a flex rod in order to couple the rotor which performs complex motion to the drilling bit. Helical motors require the stator be made of a flexible material such as a polymer which may wear out faster than the metal parts.

The new motor, thanks to its high displacement per unit length, will allow the motor assembly to be shorter and lighter than that based on the turbine or helical motor.

The mechanisms described in the detailed description of the invention having six and eight lobes on the outer rim are specially suitable for the a downhole motor because they provide high displacement, large cross section of supply channels when compared with displacement of the working chambers as well as no radial forces originated from the pressurized working chambers on the rotor.

The design with the axial gap and pressure compensation will ensure proper operation of the motor even when the motor is distorted by the pressure or external forces during drilling.

What is claimed is:

1. A downhole motor consisting of a housing which contains a toothed outer rim having six lobes on an inner surface, a toothed rotor having four lobes on an outer toothed surface and ten planetary gears;

said lobes of said rotor having at least four teeth wherein the first tooth is defined as the one whose symmetry plane coincides with the highest point on the lobe, said planetary gears engaged at all times with both the outer rim and the rotor to form ten working chambers;

said working chambers being limited by the toothed outer rim, the toothed rotor and upper and lower covers;

channels located in the upper and lower covers and the rotor to supply and drain working fluid from the working chambers of said downhole motor;

said channels further include openings located on the toothed rotor and positioned between the third and the fourth tooth on the lobe of the rotor.

2. A downhole motor as in claim 1, having 11 teeth on each of the lobes.

3. A downhole motor as in claim 1, having 10 teeth on each of the lobes.

4. A downhole motor as in claim 1 having a rotor, which can slide and is sealed in one of the side covers.

5. A downhole motor as in claim 1 having the openings inside the planetary gears connected to the high pressure in order to provide a hydrostatic cushion between the ends of the planetary gears and the side covers.

6. downhole motor as in claim 1 wherein at least one of the covers slide and is sealed inside the tooth outer rim for the purpose of providing an axial gap and pressure compensation.

7. A downhole motor consisting of a housing which contains a toothed outer rim having eight lobes on an inner surface, a toothed rotor having six lobes on an outer toothed surface and fourteen planetary gears;

said lobes of said rotor having at least four teeth wherein the first tooth is defined as the one whose symmetry plane coincides with the highest point on the lobe;

said planetary gars engaged at all times with both the outer rim and the rotor to form ten working chambers;

said working chambers being limited by the toothed outer rim, the toothed rotor and upper and lower covers;

channels located in the upper and lower covers and the rotor to supply and drain working fluid from the working chambers of said downhole motor;

said channels further include openings located on the toothed rotor and positioned between the third and the fourth tooth on the lobe of the rotor.

8. A downhole motor claim 7, having 11 teeth on each of the lobes.

9. A downhole motor as in claim 7, having 10 teeth on each of the lobes.

10. A downhole motor as in claim 7 having a rotor, which can slide and is sealed in one of the side covers.

11. A downhoie motor as in claim 7 having the openings inside the planetary gears connected to the high pressure in order to provide a hydrostatic cushion between the ends of the planetary gears and the side covers.

12. A downhole motor as in claim 7 wherein at least one of the covers slide and is sealed inside the tooth outer rim for the purpose of providing an axial gap and pressure compensation.

* * * * *